United States Patent [19]

Powel et al.

[11] Patent Number: 4,834,314

[45] Date of Patent: May 30, 1989

[54] REUSABLE WINDING TUBE

[75] Inventors: Stephen S. Powel, 4305 Tallwood Dr., Greensboro, N.C. 27410; Robert J. Darby, 2517-A Patriot Way, Greensboro, N.C. 27408

[73] Assignees: Stephen S. Powel; Robert J. Darby, both of Greensboro, N.C.

[21] Appl. No.: 200,939

[22] Filed: Jun. 1, 1988

[51] Int. Cl.[4] ..... B65H 75/28

[52] U.S. Cl. ..... 242/125.1

[58] Field of Search ..... 242/125.1, 125.2, 125.3, 242/125, 18 PW, 164, 165

[56] References Cited

U.S. PATENT DOCUMENTS

| | | | |
|---|---|---|---|
| 1,991,880 | 2/1935 | Chaffin | 242/125.1 X |
| 3,103,305 | 9/1963 | Heatherly | 242/125.1 X |
| 3,285,530 | 11/1966 | Kirchner, Jr. et al. | 242/125.1 |
| 3,625,451 | 12/1971 | Anderson | 242/125.1 |
| 3,658,275 | 4/1972 | Lahmann | 242/125.1 X |
| 3,717,291 | 2/1973 | Adams et al. | 242/125.1 X |
| 4,369,933 | 1/1983 | Bedenbaugh | 242/125.1 |
| 4,371,130 | 2/1983 | Case | 242/125.1 |

FOREIGN PATENT DOCUMENTS

| | | | |
|---|---|---|---|
| 2463088 | 3/1981 | France | 242/125.1 |

*Primary Examiner*—Stanley N. Gilreath

*Attorney, Agent, or Firm*—Rhodes, Coats & Bennett

[57] ABSTRACT

An end cap is releasably mounted on the end of a cylindrical hollow tube to form a reusable cylindrical yarn carrier or winding tube which carries a filamentary or fibrous yarn thereon. The confronting ends of the hollow tube and end cap define a peripheral groove therebetween. A minor portion of the peripheral groove is relatively narrow (locking portion), while the remaining major portion of the groove is relatively wider (lead-in portion). When the yarn carrier has been emptied, the end cap is separated from the hollow tube and the residual fibers or filaments vacuumed or stripped away.

11 Claims, 2 Drawing Sheets

FIG. 1
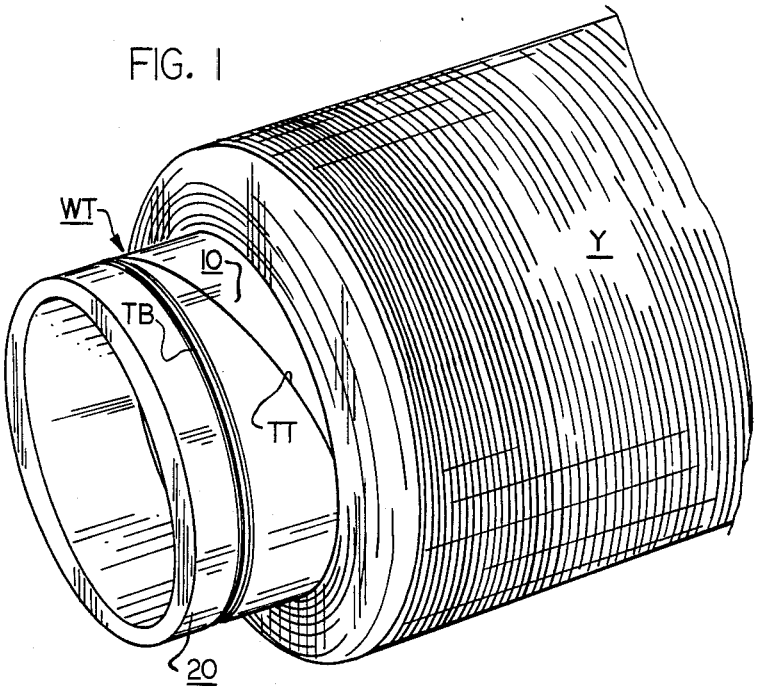
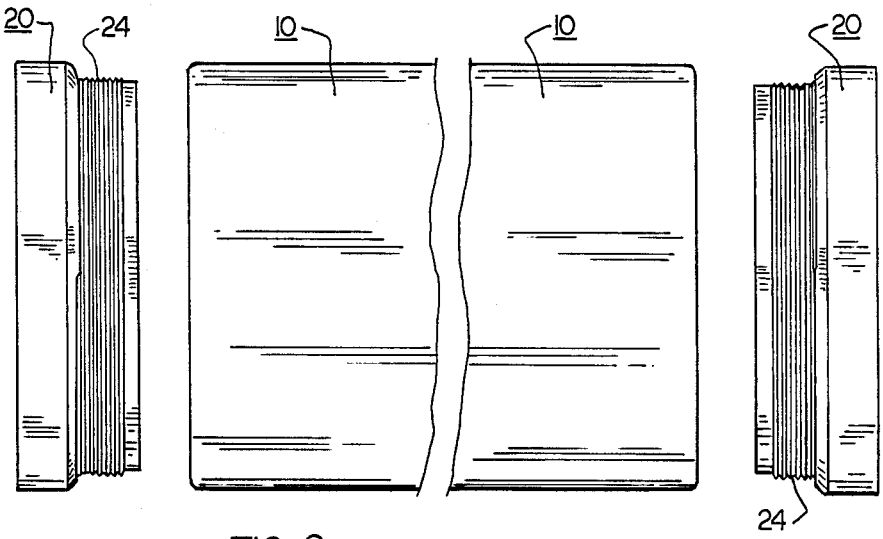
FIG. 2

REUSABLE WINDING TUBE

BACKGROUND AND SUMMARY OF THE PRESENT INVENTION

The present invention is directed to winding tubes, and more particularly to a reusable winding tube in which the fibers or filaments are more easily removed from the peripheral groove which carries the transfer bunch once the package has been emptied.

In conventional automatic winding operations, yarn is wound onto a cylindrical paper tube. One end of the paper tube includes a peripheral groove cut into the surface thereof. The peripheral groove is divided into two arcuate portions. The greater arcuate portion (approximately 270°) is wider and referred to as the lead-in portion, while the smaller (approximately 90°) arcuate portion (locking portion) is narrower and locks one or more of the initial strands of yarn therein during the initial few turns of the automatic winding operation. These strands are hereinafter and commonly referred to as the "transfer bunch." The completed yarn package is removed from the winding machine, and stored or shipped for further processing. During the further processing, the yarn is then removed from the yarn carrier.

When the yarn is removed from the package, the last few strands of the transfer bunch remain in the lead-in and locking portions of the groove. Because of the construction of the paper tubes, it is very difficult to remove these remaining strands of fibrous or filamentary material from the grooves. Previous attempts to remove these strands have included vacuum stripping, cutting of the strands, or a combination of both. Neither technique is satisfactory, because vacuum stripping simply does not remove all the fibrous or filamentary material. Cutting the bunch generally results in damage to the surface of the tube making it unsuitable for further use. Such damage occurs when the laminates of the paper tube are niched, cut, or otherwise interrupted. Use at high speeds then tends to cause delamination.

As a result, paper winding tubes are generally not reusable. There have been some attempts to reuse the tubes by providing the transfer grooves at each end of the tube, so that the tube can be reused at least once. However, often the tube is otherwise damaged during the automatic doffing and emplacement operations which substantially eliminates the reuse of the paper tubes. Conventional paper tubes are relatively expensive (50¢ to $1.50 apiece) and hundreds of thousands per year are used by typical yarn manufacturers. Thus the cost of non-reusable yarn carriers is extremely high.

Merely the replacement of paper tubes with a stronger material such as a polymeric material or aluminum is not an obvious solution. First the transfer groove cannot satisfactorily be molded or machined in the wall of a polymeric or metallic tube. Secondly merely a change of material does not solve the problems created by the necessity to clean the starting bunch groove, as it is still not easy to vacuum the groove, and utilizing a knife will still damage the surface of the tube so that it cannot be reused. While the use of polymeric material or metallic material such as aluminum is a first step toward an improved tube, it has been found that some technique for the cleaning of the transfer groove must be provided in order to achieve a reusable winding tube.

Examples in the prior art of separable yarn carriers are illustrated in the U.S. Pat. Nos. to Chaffin No. 1,991,880; Moss No. 2,837,297; and Underwood No. 3,971,526. However, none of these yarn carriers are for automatic winding operations or for the purpose of solving the problem of removing residual fibers and filaments from a transfer bunch.

In the broadest aspect of the present invention then, the tube is made reusable by the combination of selecting an appropriate material and a unique fabrication technique. The tube is formed of a polymeric or metallic material in two separable parts, i.e. the main hollow tube portion and a removable end cap. A peripheral groove of unique shape is formed between confronting walls of the end cap and hollow tube to receive the transfer bunch during the automatic winding operation. After the yarn package is emptied the end cap is removed or partially removed from the hollow tube portion, the fibers or filaments vacuumed or stripped away, and the end cap replaced. The yarn carrier is then ready for reuse.

In its more specific aspects the reusable winding carrier of the present invention includes a hollow tube having an outer, substantially cylindrical surface adapted to carry a filamentary or fibrous yarn thereon. The end cap includes an outer substantially cylindrical surface generally of the same radius as the outer surface of the hollow tube. The end cap and hollow tube include mating threads or other releasable attachment means for releasably mounting the end cap on at least one end of the hollow tube. It is possible that both ends of the hollow tube may include releasable end caps to make the winding tube last even longer.

A peripheral groove is formed between the hollow tube and end cap encircling the yarn carrier. The groove is formed with a relatively narrow locking portion extending around a minor portion (approximately 90°) of the periphery of the tube and a relatively wider lead-in portion extending around the remaining major of the periphery. The lead-in portion guides the first few turns of the transfer bunch into the locking groove. The wider and narrower portions of the peripheral groove are formed by molding recesses into or chamfering the confronting walls of the hollow tube and/or end cap during the fabrication of the components.

The construction of the present invention combines the benefits of overall economy for the plant; facilitates cleaning of the transfer groove; allows replacement or refurbishment of worn or damaged portions of the winding tube assembly; and minimizes the chance of damage to the tube during shipment and use.

It is therefore an object of the present invention to provide a reusable yarn carrier or winding tube by facilitating the cleaning of the transfer groove.

It is another object of the present invention to provide a winding tube of the type described in which the end portion of the winding tube is removable from the main body portion.

Other objects and a fuller understanding of the invention will become apparent upon reading the following detailed description of a preferred embodiment along with the accompanying drawings in which:

FIG. 1 is a perspective view illustrating a yarn package wound on a winding tube made in accordance with the present invention;

FIG. 2 is a side view, with parts broken away, illustrating the winding tube of the present invention;

DETAILED DESCRIPTION OF A PREFERRED EMBODIMENT

Figure 3:
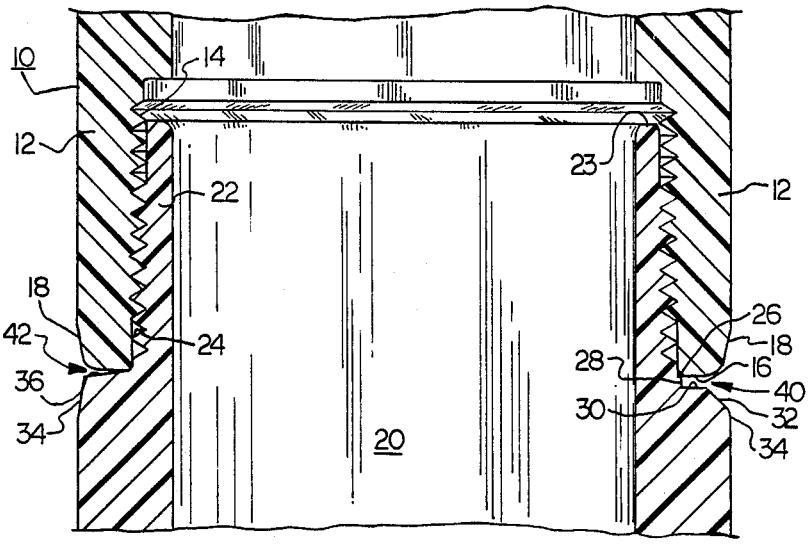
FIG. 3 is an enlarged sectional view taken diametrically through one end of the yarn carrier of FIG. 2.

Turning now to the drawings, and particularly to FIG. 1, there is illustrated a yarn package formed in accordance with conventional automatic winding techniques. The yarn package includes a winding tube WT about which thousands of turns of yarn Y are wrapped. The winding tube WT is formed of at least two parts, i.e. the cylindrical hollow tube 10 and at least one end cap 20. A groove extending around the periphery is formed between the hollow tube 10 and releasable end cap 20. As the yarn package is initially formed, a relatively small number of turns of the yarn are guided into the groove where they are locked and form the transfer bunch. The length of yarn extending between the transfer bunch and the yarn package Y is referred hereinafter as the transfer tail TT.

An empty winding tube WT is initially emplaced on the spindle (not shown) of a winding machine ready to have yarn wound thereupon. During the automatic winding operation of polyester or any other extruded polymeric yarn thereon, a vacuum hose is receiving the continuous extrusion of polyester or other polymeric yarn filament through a spinneret awaiting the emplacement of the winding tube. The vacuum hose is then held near the bottom periphery of the winding tube WT while a hand-held wire instrument is used by the operator to lift or move the yarn filament into contact with the peripheral groove 42. As the yarn is guided into the peripheral groove 42 it latches up and breaks from the remainder of the yarn being carried away by the vacuum hose. After the break occurs, rotation of the winding tube causes a few turns to form a transfer bunch in the peripheral groove 42. The transfer bunch includes approximately one hundred or less turns. Formation of the transfer bunch functions to lock the leading end of the yarn tail as well as to maintain the "off-spec" yarn out of the yarn package while the speed of the yarn being extruded and the rotation of the tube is stabilized. After the transfer bunch is completed, the winder goes into a normal wind cycle with the yarn being wrapped around the main body of the hollow tube 10. Once the yarn package is emptied, the winding tube WT must either be discarded, or else the groove in which the transfer bunch is wound must be cleaned of remaining fibers. While in conventional winding techniques, for all practical purposes the groove of a paper tube cannot be cleaned, in the present invention such cleaning is made possible and even facilitated.

Thus, in the present invention, once the winding tube WT is emptied, the end cap 20 is loosened from the hollow tube 10, whereupon the remaining fragments, filaments, or fibers of the transfer bunch may be easily vacuumed or stripped away. The end cap 20 is then tightened, and the yarn carrier WT is ready for reuse.

Turning now to FIG. 2 there is illustrated an empty winding tube WT. A hollow cylindrical tube 10 is provided with a releasable end cap 20 on one end thereof. The periphery of tube 10 and end cap 20 are substantially coextensive. As illustrated in FIG. 2, a second end cap 20 may be releasably attached to the opposite end, in which case the life expectancy of the tube may be extended, and either end of the tube may serve to accumulate the transfer bunch. However, it is felt that a quite satisfactory, long lasting winding tube WT can be fabricated which includes the end cap 20 on one end alone. Both the hollow tube 10 and the end cap(s) 20 are formed of a more permanent material such as polymers selected from the group containing polycarbonate, PBT, PVC, ABS, polytetraphthalate, glass filled polymers, and carbon filled polymers. The tubes may even be formed of aluminum, magnesium, or some other lightweight metallic material. One side advantage of the present invention is that paper tubes are limited as to the spindle speed. It is anticipated that polymeric or aluminum winding tubes may be operated at much higher spindle speeds thus leading to other economies for the yarn manufacturer.

Figure 4:
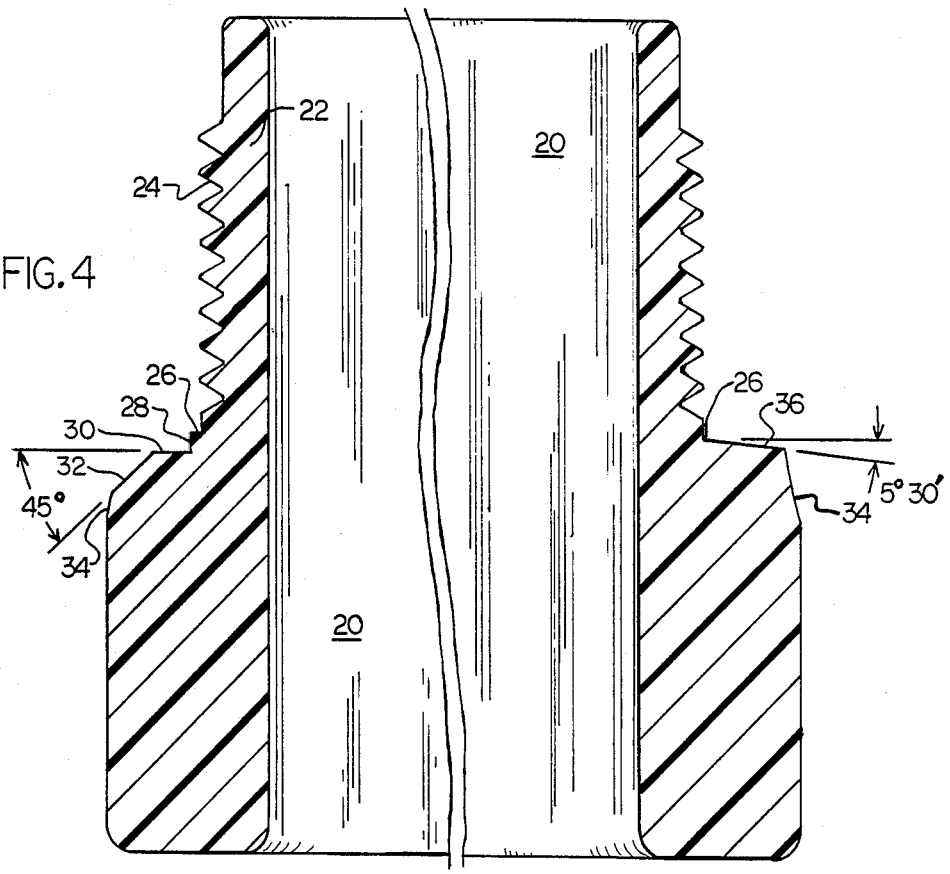
FIG. 4 is a greatly enlarged sectional view of the end cap removed from the cylindrical portion of the winding tube.

Looking at FIGS. 3 and 4, the relationship between the end cap 20 and hollow tube 10 is best shown as a result of the enlarged illustrations. The hollow tube 10 includes a marginal or terminal portion 12 having reduced wall thickness and internal threads 14 extending peripherally around the interior wall thereof. Hollow tube 10 terminates in an end wall 16 which is the terminal end of marginal portion 12. A tapered or chamfered surface 18 joins the outer periphery of hollow tube 10 and the end wall 16 to guide yarn being wrapped around hollow tube 10 in the area of the end portion thereof inwardly toward the peripheral grooves 40,42.

The end cap 20 includes an axially extending end or nose 22 of reduced wall thickness and having outer threads 24 around the periphery thereof which mate with and engage the inner threads 14 of hollow tube 10. The mating threads 14,24 form a means for releasably mounting the end cap 20 onto the hollow tube 10. Alternate mounting means might include snap fits, bayonet tabs, male and/or female tapered marginal portions tapered, and the like, it being understood that the mating threads 14,24 are representative thereof. Immediately adjacent the base of threads 24 on end cap 20 is a radially extending peripheral rim 26, which forms a stop means against which the end wall 16 of the hollow tube 10 engages as the end cap is mounted on the hollow tube 10. The marginal or end portion 12 of hollow tube 10 is longer than the nose 22 of the end cap 20, so that the end wall 16 will engage peripheral rim 26 prior to the time the terminal wall 23 of the end cap 20 engages the corresponding portion of hollow tube 10.

A shoulder 28 extends around approximately three-fourths of the periphery of the end cap 20 to guide yarn into the groove between wall 30 and the end wall 16 (approximately 270°) and separates the peripheral rim 26 from a second or groove forming wall 30. The shoulder 28 maintains a separation (approximately 0.22 inches) between the end wall 16 of hollow tube 10 and the second groove forming wall 30 which separation is substantially greater than the diameter of the yarn being wound thereon. A bevel surface 32 (approximately 45°) angles outwardly from the groove forming wall 30 toward the outer periphery of the end cap 20. Finally a slight chamfer 34 connects the outer periphery of end cap 20 with the bevel surface 32.

In the remaining one-fourth (approximately 90°) of the periphery of the end cap, the shoulder 28 and groove forming wall 30 are replaced by the slightly angled peripheral rim 36. Rim 36 does not extend radially, rather is tapered away from an imaginary radius by an angle of approximately 5° 30 min. Again the second rim 36 is connected to the outer periphery of end cap 20 by a chamfered surface 34.

Thus formed, there is a peripheral groove means formed between the confronting walls of the hollow tube and the end cap which encircles the yarn carrier. The groove means includes first a relatively wide lead-in portion 40 which is formed by shoulder 28 and which extends approximately 270° around the periphery of the winding tube WT. Secondly a relatively narrow locking portion 42 is formed between the end wall 16 of hollow tube 10 and the second peripheral rim 36 of end cap 26. So arranged, the yarns of the transfer bunch are directed toward the lead-in groove 40 and into the locking groove 42 as the winding tube is rotated.

As can be easily seen from FIGS. 3 and 4, when the yarn package is emptied, yarn fibers and filaments tend to remain in the lead-in groove 40 and the locking groove 42. Such yarn ends cannot be vacuumed or stripped away in conventional, integrally formed paper tubes. However, the present construction allows the operator to unscrew the end cap slightly, whereupon the fibers and filaments are released and can be easily removed by suction or other stripping techniques.

As suggested earlier, the separable end cap and peripheral groove configuration may appear at both ends of the winding tube, if desired. Also, the hollow tube and/or end cap may be formed of polymeric or metallic material to increase the longevity thereof.

While the invention has been described in detail hereinabove, it is obvious that various changes and modifications might be made without departing from the scope of the invention which is set forth in the accompanying claims, in which:

What is claimed is:

1. A reusable yarn carrier comprising:

(a) a hollow tube having an outer, substantially cylindrical surface adapted to carry a fibrous or filamentary yarn thereon;

(b) an end cap having an outer cylindrical surface substantially coextensive with the outer surface of said hollow tube, means for releasably mounting said end cap on at least one end of said hollow tube;

(c) confronting walls of said tube and end cap defining a peripheral groove therebetween encircling said yarn carrier, said peripheral groove comprising a relatively narrow locking portion extending partially around said periphery and a relatively wider lead-in portion around the remainder of said periphery;

(d) said locking portion further including an angled peripheral rim on one of said confronting walls tapering from an imaginary radius, said angled peripheral rim cooperating with said other confronting wall to engage and lock one or more yarn strands therebetween;

(e) whereby the lead-in portion guides the first few turns of the transfer bunch into the locking portion and said confronting walls of said tube and end cap of said yarn carrier are separable to loosen trapped fibers and facilitate cleaning and reuse.

2. The yarn carrier according to claim 1 wherein said hollow tube and said end cap are formed of a polymeric material.

3. The yarn carrier according to claim 2 wherein said polymeric material is polycarbanate.

4. The yarn carrier according to claim 1 wherein said yarn carrier is formed of a metallic material selected from the group consisting of aluminum and magnesium.

5. The yarn carrier according to claim 1 wherein the means for releasably mounting said end cap on at least one end of said hollow tube includes:

(a) a marginal end of one of said hollow tube and end cap having a reduced wall thickness and being provided with internal threads thereon;

(b) a cooperating marginal end portion of the other of said hollow tube and end cap having a reduced wall thickness and being provided with exterior threads thereon; and (c) said interior threads and exterior threads mating together to permit assembly and disassembly of said end cap.

6. The yarn carrier according to claim 5 wherein one of said end caps is provided on each end of said hollow tube.

7. The yarn carrier according to claim 1 wherein, said lead-in portion extends approximately 270° around the periphery of said tube and said locking portion extends approximately 90° around the periphery of said tube.

8. The yarn carrier according to claim 7 wherein said lead-in portion is formed by a shoulder separating the confronting walls of said hollow tube and said end cap.

9. The yarn carrier according to claim 8 wherein said lead-in portion has a width greater than the diameter of the yarns being wound thereon.

10. The reusable yarn carrier according to claim 1 wherein said lead-in portion further including a bevel surface intersecting and angled outwardly from said angled peripheral rim toward the outer periphery of said tube or end cap; said angled peripheral rim and said bevel surface being spaced from the other confronting wall in said lead-in portion by a shoulder.

11. The reusable yarn carrier according to claim 1 wherein said peripheral groove further including stop means for positioning the seated cap at a prescribed location in said hollow tube, thereby ensuring definition of said peripheral groove.

* * * * *